US011679055B2

(12) United States Patent
Wang et al.

(10) Patent No.: US 11,679,055 B2
(45) Date of Patent: Jun. 20, 2023

(54) LUMBAR HERNIATED DISC TREATMENT DEVICE

(71) Applicant: The Third Hospital of Hebei Medical University, Shijiazhuang (CN)

(72) Inventors: Juan Wang, Shijiazhuang (CN); Di Zhang, Shijiazhuang (CN); Wei Chen, Shijiazhuang (CN); Yingze Zhang, Shijiazhuang (CN)

(73) Assignee: The Third Hospital of Hebei Medical University, Shijiazhuang (CN)

( * ) Notice: Subject to any disclaimer, the term of this patent is extended or adjusted under 35 U.S.C. 154(b) by 859 days.

(21) Appl. No.: 16/699,849

(22) Filed: Dec. 2, 2019

(65) Prior Publication Data

US 2021/0000676 A1 Jan. 7, 2021

(30) Foreign Application Priority Data

Jul. 5, 2019 (CN) ..... 201910602912.9

(51) Int. Cl.
*A61H 1/02* (2006.01)

(52) U.S. Cl.
CPC ..... *A61H 1/0229* (2013.01); *A61H 1/0292* (2013.01); *A61H 2001/0203* (2013.01); *A61H 2201/0192* (2013.01); *A61H 2201/123* (2013.01); *A61H 2201/1215* (2013.01); *A61H 2201/163* (2013.01); *A61H 2201/1621* (2013.01); *A61H 2201/1633* (2013.01); *A61H 2201/1638* (2013.01); *A61H 2201/1664* (2013.01); *A61H 2205/081* (2013.01)

(58) Field of Classification Search
CPC ..... A61H 1/00; A61H 1/0218; A61H 1/0229; A61H 1/0292; A61H 1/0222; A61H 2001/0203; A61H 2001/0192; A61H 2001/1215; A61H 2001/123; A61H 2001/1621; A61H 2001/163; A61H 2001/1633; A61H 2001/1638; A61H 2001/1664; A61H 2001/5097; A61H 2205/081; A61H 23/02; A61H 23/0263; A61H 2203/0406; A61F 5/042; A61N 2/002; A61N 2/12
See application file for complete search history.

(56) References Cited

U.S. PATENT DOCUMENTS 1,356,365 A * 10/1920 Edward ..... A61H 1/0218 297/464
5,830,169 A * 11/1998 Pierce ..... A61H 1/0229 602/32
11,246,788 B2 * 2/2022 Kao ..... A61H 1/005
(Continued)

FOREIGN PATENT DOCUMENTS

CN 106667719 A * 5/2017
CN 109620506 A * 4/2019 ..... A61F 5/042

*Primary Examiner* — Timothy Astanis
*Assistant Examiner* — Matthew R Moon
(74) *Attorney, Agent, or Firm* — Qinghong Xu

(57) ABSTRACT

A lumbar herniated disc treatment device includes an upright post, a rail vertically mounted on the upright post, a chest fixing device up-and-down, slidably mounted on the rail, a lumbar traction and torsion device up-and-down slidably mounted on the rail and positioned below the chest fixing device, and a waist massage device up-and-down slidably mounted on the rail and positioned between the chest fixing device and the lumbar traction and torsion device.

14 Claims, 7 Drawing Sheets

(56) References Cited

U.S. PATENT DOCUMENTS

2006/0048785 A1* 3/2006 Dalen ..... A61G 5/1091
128/845
2015/0190265 A1* 7/2015 Kreuzer ..... A61H 1/02
602/33

* cited by examiner

LUMBAR HERNIATED DISC TREATMENT DEVICE

CROSS-REFERENCE TO RELATED APPLICATIONS

This application is based on and claims priority to and benefit of Chinese patent application No. 201910602912.9, filed on Jul. 5, 2019, the entire contents of which are incorporated herein by reference.

TECHNICAL FIELD

This disclosure relates to a lumbar herniated disc treatment device capable of implementing three physical therapies simultaneously, which can effectively treat lumbar herniated disc diseases and belongs to technical fields of medical instruments.

BACKGROUND

Lumbar herniated disc is a common lumbar disease, which is induced by many factors, such as poor sitting and standing posture, long-term bending or engaging in heavy physical labor, long-term desk work, often looking down at mobile phones, etc. At present, the treatments for the lumbar herniated disc mainly include drug treatments, physical treatments and surgical treatments. Due to many limitations and risks of the drug treatments and the surgical treatments, people prefer the physical treatments.

Physical therapy includes traction and massage. Traction therapy generally requires a patient to lie flat on a traction bed, to treat a lumbar spine and its surrounding muscles by applying a tensile force thereon. This therapy has a disadvantage: the traction bed needs a large occupation, so that a place for using the traction bed is largely limited. A tuina manipulation is a targeted massage to a lesion site, but such manual massage is expensive and the treatment effect is greatly influenced by human factors, and thus having certain risks. Using a massage bed for treatment can effectively reduce treatment costs and treatment risks. However, because of different heights of the patients, waist massage instruments mounted at fixed positions of the bed are generally difficult to align with the patient's waist, thus seriously affecting the treatment effect.

SUMMARY

According to one aspect of the present disclosure, a lumbar herniated disc treatment device includes:

an upright post;

a rail vertically mounted on the upright post;

a chest fixing device up-and-down slidably mounted on the rail;

a lumbar traction and torsion device up-and-down slidably mounted on the rail and positioned below the chest fixing device; and a waist massage device up-and-down slidably mounted on the rail and positioned between the chest fixing device and the lumbar traction and torsion device.

According to one embodiment of the present disclosure, a rack parallel to the rail is mounted on the upright post, and the lumbar traction and torsion device includes:

a lower sliding seat up-and-down slidably mounted on the rail, and the back surface of the lower sliding seat being provided with a gear meshed with the rack;

an arc-shaped guide rail mounted on the front of the lower sliding seat;

an arc rack arranged on the arc guide rail;

a pulling motor mounted on the lower sliding seat for driving the rotation of a lower synchronous gear;

a torsion seat slidably mounted on the arc-shaped guide rail, the torsion seat being provided with a gear meshed with the arc-shaped rack;

a torsion motor mounted on the torsion seat for driving the rotation of the gear on the torsion seat;

a lower synchronous opening and closing mechanism mounted on the torsion seat; and a pair of ilium pressing plates mounted on the lower synchronous opening and closing mechanism and arranged opposite to each other.

According to one embodiment of the present disclosure, the lower synchronous opening and closing mechanism includes:

a pair of lower rotating shafts vertically mounted on the torsion seat;

a pair of lower synchronous gears respectively mounted on the pair of lower rotating shafts and meshed with each other; and a pair of lower clamping arms respectively mounted on the pair of lower rotating shafts;

wherein the pair of ilium pressing plates are respectively mounted at ends of the pair of the lower clamping arms.

According to one embodiment of the present disclosure, the lower synchronous opening and closing mechanism further includes:

a lower shaft brake mounted on the torsion seat and connected to one of the pairs of lower rotating shafts.

According to one embodiment of the present disclosure, the lower clamping arm is L-shaped.

According to one embodiment of the present disclosure, the pair of ilium pressing plates are rotatably mounted on the pair of lower clamping arms, respectively.

According to one embodiment of the present disclosure, each of the ilium pressing plates includes:

an arc-shaped lower intermediate plate pivoted to the lower clamping arm, and two lower side plates respectively pivoted to both sides of the lower intermediate plate.

According to one embodiment of the present disclosure, the lumbar traction and torsion device further includes:

two arc-shaped handrails respectively pivoted to both ends of the arc-shaped guide rail, wherein the handrails and the arc-shaped guide rail have the same radian.

According to one embodiment of the present disclosure, the chest fixing device includes:

an upper sliding seat up-and-down mounted on the rail and positioned above the lower sliding seat, and the back surface of the upper sliding seat being provided with a gear meshed with the rack;

a lifting motor mounted on the upper sliding seat for driving rotation of the gear on the upper sliding seat;

an upper synchronous opening and closing mechanism mounted on the front of the upper sliding seat; and a pair of armpit supporting plates mounted on the upper synchronous opening and closing mechanism and arranged opposite to each other.

According to one embodiment of the present disclosure, the upper synchronous opening and closing mechanism includes:

a pair of upper rotating shafts vertically mounted on the upper sliding seat;

a pair of upper synchronous gears respectively mounted on the pair of upper rotating shafts and meshed with each other; and a pair of upper clamping arms respectively mounted on the pair of upper rotating shafts;

wherein the pair of armpit supporting plates are rotatably mounted at the ends of the pair of upper clamping arms, respectively.

According to one embodiment of the present disclosure, the upper synchronous opening and closing mechanism further includes:

an upper shaft brake mounted on the upper sliding seat and connected with one of the pair of upper rotating shafts.

According to one embodiment of the present disclosure, each of the armpit supporting plates includes:

an arc-shaped upper middle plate pivoted to the upper clamping arm, and two side plates pivoted to both sides of the upper intermediate plate respectively.

According to one embodiment of the present disclosure, the waist massage device includes:

an intermediate sliding seat up-and-down slidably mounted on the rail, and the back surface of the intermediate sliding seat being provided with a gear meshed with the rack;

a height adjusting motor mounted on the intermediate sliding seat for driving rotation of the gear on the intermediate sliding seat;

a pair of intermediate rotating shafts vertically mounted on the intermediate sliding seat, the pair of intermediate rotating shafts being positioned at both sides of the front of the intermediate sliding seat;

a pair of intermediate clamping arms having one end respectively connected with the pair of intermediate rotating shafts;

an abdomen baffle having two ends respectively connected with the other end of the pair of intermediate clamping arms;

a frame movably connected to the pair of intermediate clamping arms and arranged opposite to the abdominal baffle;

a horizontal pushing rod having one end fixed on the intermediate sliding seat and the other end extending towards the limiting frame; and one or more massagers mounted at the end of the horizontal pushing rod.

According to one embodiment of the present disclosure, the horizontal pushing rod is a telescopic rod.

According to one embodiment of the present disclosure, the waist massage device comprises two electromagnetic massagers.

According to the lumbar herniated disc treatment device, the lower sliding seat is mounted on the rail on the upright post, the upper part of the lower sliding seat is fixed with an arc-shaped guide rail and an arc-shaped rack, and the pulling motor is fixed on the lower sliding seat and is connected with the upright post through a gear-rack mechanism.

According to the lumbar herniated disc treatment device, the chest fixing device includes an upper sliding seat, a lifting motor and two armpit supporting plates. The upper sliding seat is arranged above the lower sliding seat and arranged on the rail on an upright post. The lifting motor is fixed on the upper sliding seal and connected with the upright post through the gear-rack mechanism. And the two armpit supporting plates are respectively abut at two armpits of the patient and respectively connected with the upper sliding seat through the two upper clamping arms.

The lumbar herniated disc treatment device also includes a waist massage device. The waist massage device includes an intermediate sliding seat, a height adjusting motor, an abdomen baffle, a limiting frame, a horizontal pushing rod and two intermediate clamping arms. The intermediate sliding seat is arranged between the upper sliding seat and the lower sliding seat and arranged on the rail of the upright post. The height adjusting motor is fixed on the intermediate sliding seat and connected with the upright post through the gear-rack mechanism. The abdomen baffle and the limiting frame are respectively attached to the patient's abdomen and back. Each of the two intermediate clamping arms has one end hinged with the intermediate sliding seat through a vertical hinge shaft and the other end hinged with two sides of the abdominal baffle respectively. The limiting frame has two ends respectively connected with the middle parts of the two intermediate clamping arms through hinges. The horizontal pushing rod has one end hinged with the intermediate sliding seat through the vertical hinge shaft and the other end positioned in the limiting frame and provided with an electromagnetic massager corresponding to the patient's back.

According to the lumbar herniated disc treatment device, the two upper clamping arms are connected with the upper sliding seat through a synchronous opening and closing mechanism. The synchronous opening and closing mechanism includes an upper shaft brake, two upper rotating shafts and two upper synchronous gears. The two upper rotating shafts penetrate through vertical through holes on the upper sliding seat and rotationally connected with the upper sliding seat. Each of the upper rotating shafts is fixed with an upper clamping arm. The two upper synchronous gears are meshed with each other and fixed on the two upper rotating shafts, respectively. The upper shaft brake is fixed on the upper sliding seat and connected with one upper rotating shaft.

According to the lumbar herniated disc treatment device, the lower clamping arm connected with the two ilium pressing plates is connected to the torsion seat through the lower synchronous opening and closing mechanism. The lower synchronous opening and closing mechanism includes a lower shaft brake, two lower rotating shafts and two lower synchronous gears. The two lower rotating shafts pass through the vertical through holes on the torsion seat and rotationally connected with the torsion seat. Each of the lower rotating shafts is fixed with one lower clamping arm. Two lower synchronous gears are meshed with each other and respectively fixed on the two lower rotating shafts. The lower shaft brake is fixed on the torsion seat and connected with one lower rotating shaft.

According to the lumbar herniated disc treatment device, the output ends of the lifting motor, the height adjusting motor, the torsion motor and the pulling motor are all provided with a speed reducer. The speed reducer shares the same vertical rack with a gear-rack mechanisms connected with the lifting motor, the height adjusting motor and the pulling motor.

According to the lumbar herniated disc treatment device, the upper sliding seat, the intermediate sliding seat and the lower sliding seat share two rails. The two rails are respectively positioned at two sides of the vertical rack.

According to the lumbar herniated disc treatment device, each of the upper clamping arms is rotationally connected with the corresponding armpit supporting plate through the vertical hinge shaft. Each of the lower clamping arms is rotationally connected with the corresponding ilium pressing plate through the vertical hinge shaft.

According to the lumbar herniated disc treatment device, two electromagnetic massagers are arranged, and respectively positioned at two sides of the lumbar spine of the patient.

According to the lumbar herniated disc treatment device, the upper shaft brake and the lower shaft brake are electromagnetic clutch brakes.

According to the lumbar herniated disc treatment device, handrails are arranged on both sides of the lower sliding seat.

According to the present disclosure, the treatment device with various physical therapies is mounted on the same upright post, which can not only effectively improve the treatment efficiency and effect of the lumbar herniated disc diseases, reduce the treatment costs, but also have smaller occupation area than the conventional traction bed and massage bed, and thus being suitable for families and various medical institutions.

BRIEF DESCRIPTION OF THE DRAWINGS

The present disclosure will be described in further detail below with reference to the accompanying drawings and detailed embodiments.

DETAILED DESCRIPTION

Figure 1:
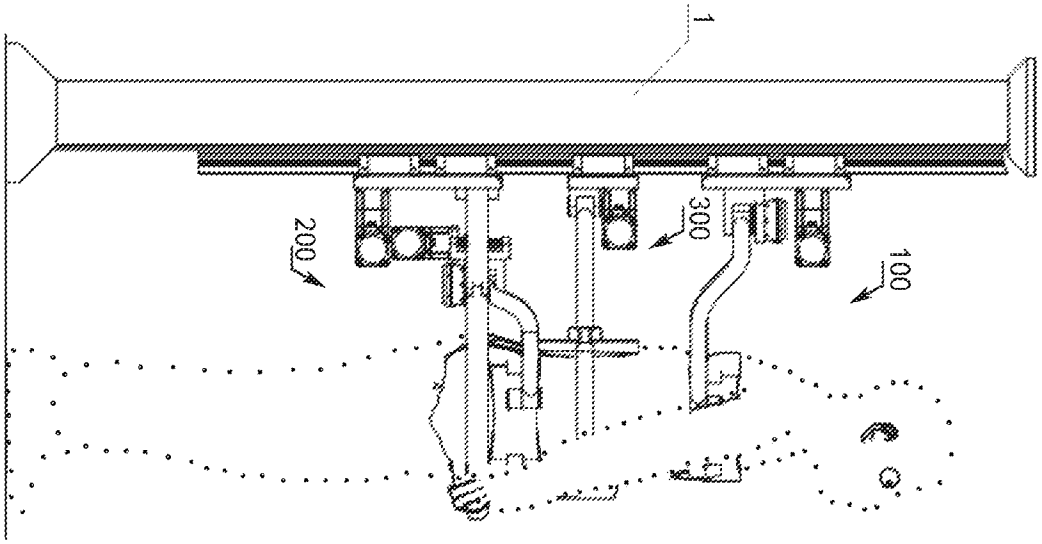
FIG. 1 is a schematic view showing corresponding relationship between a lumbar herniated disc treatment device of the present disclosure when in use and a human body.
Figure 2:
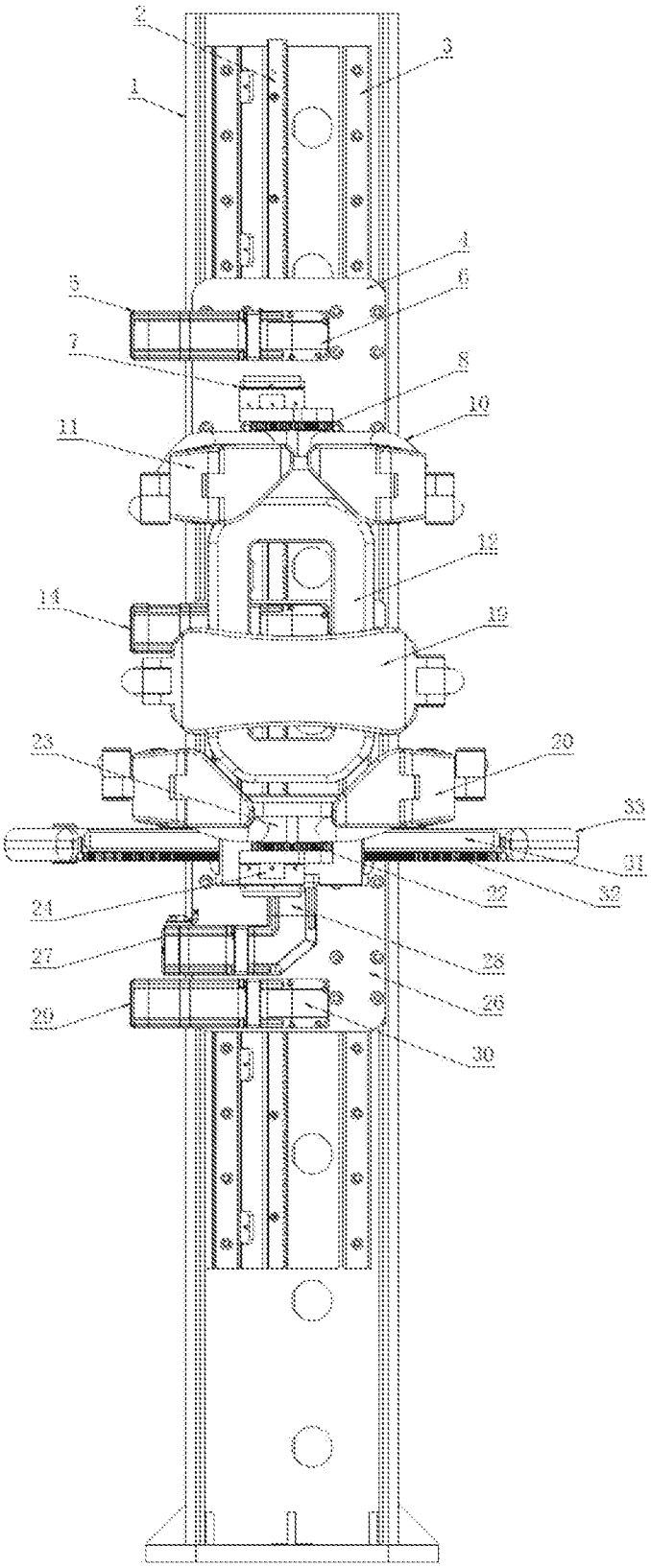
FIG. 2 is a front view of the lumbar herniated disc treatment device of the present disclosure.
Figure 3:
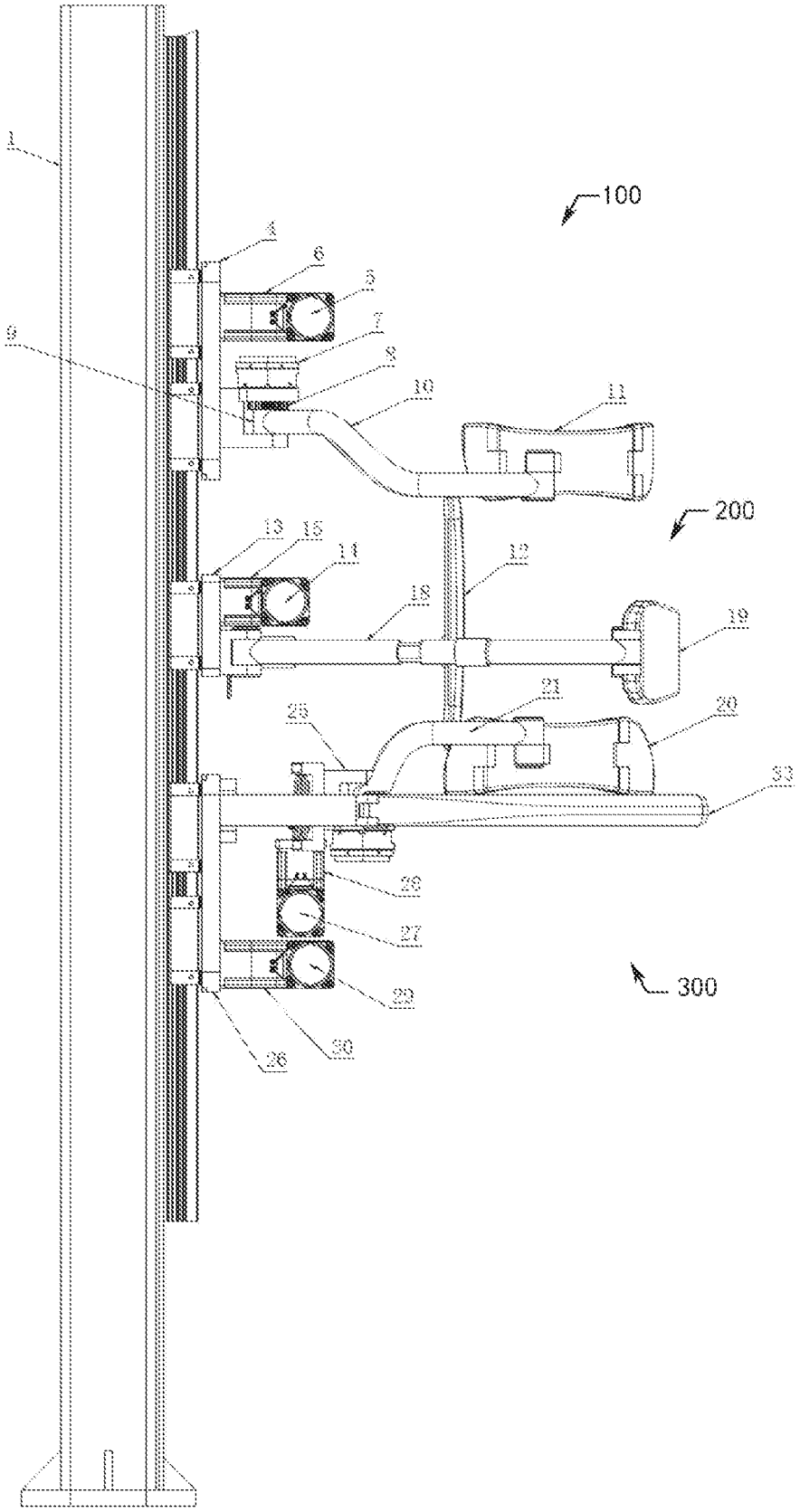
FIG. 3 is a side view of the lumbar herniated disc treatment device of the present disclosure.
Figure 4:
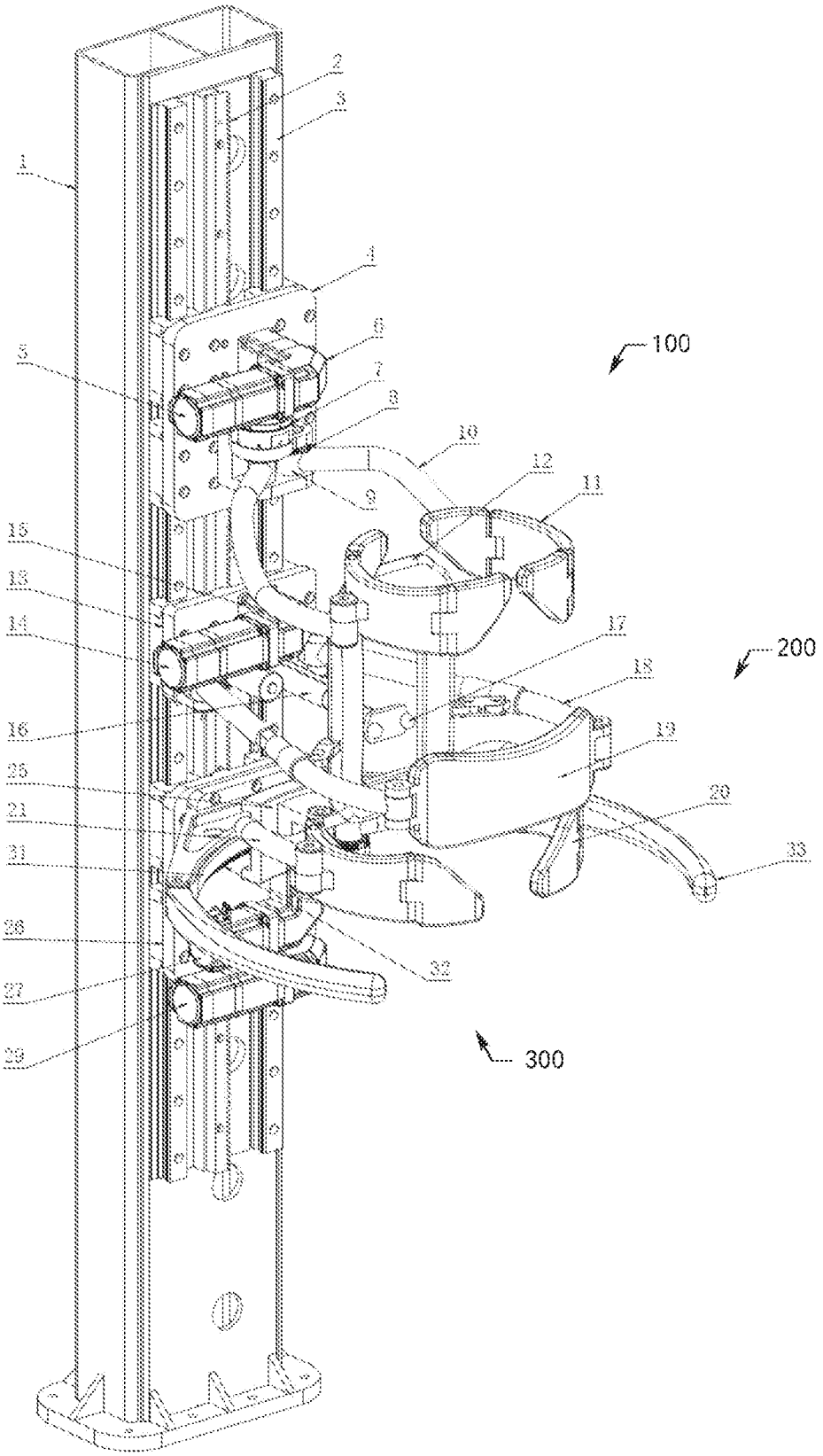
FIG. 4 is a perspective view of the lumbar herniated disc treatment device of the present disclosure.
Figure 5:
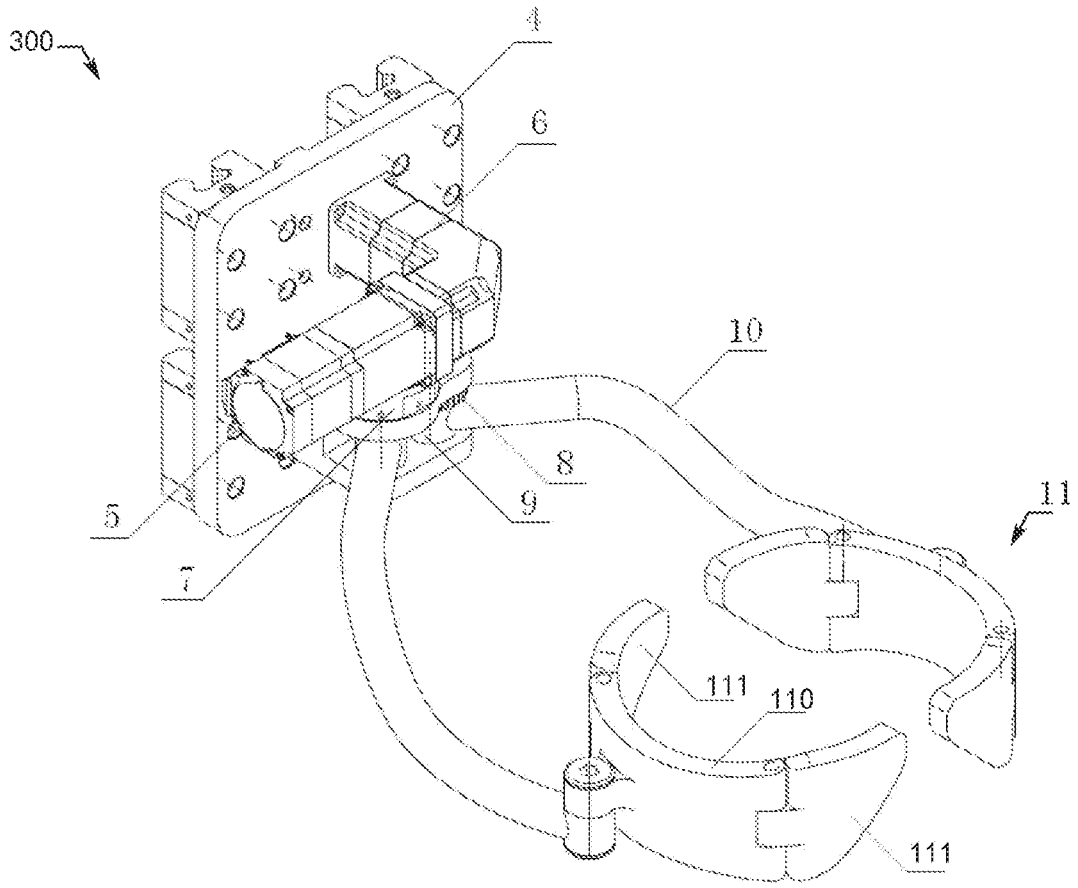
FIG. 5 is a schematic structural view of a chest fixing device in the lumbar herniated disc treatment device of the present disclosure.
Figure 6:
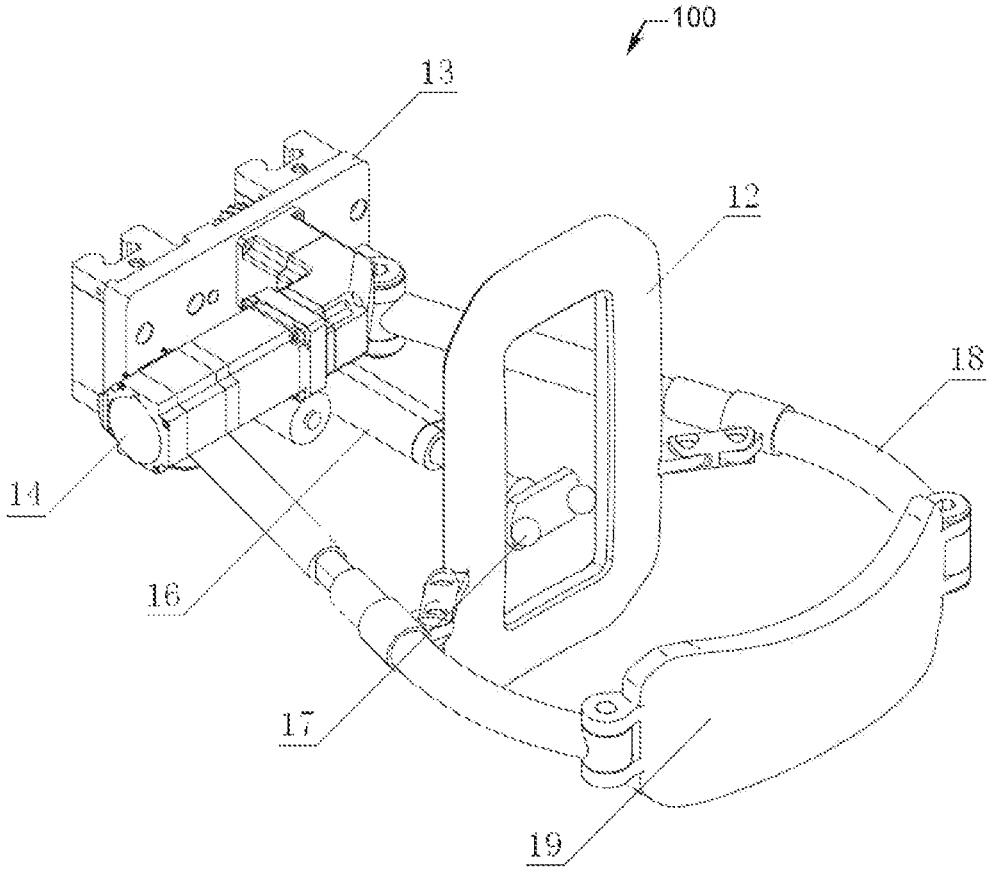
FIG. 6 is a schematic structural view of a waist massage device in the lumbar herniated disc treatment device of the present disclosure.
Figure 7:
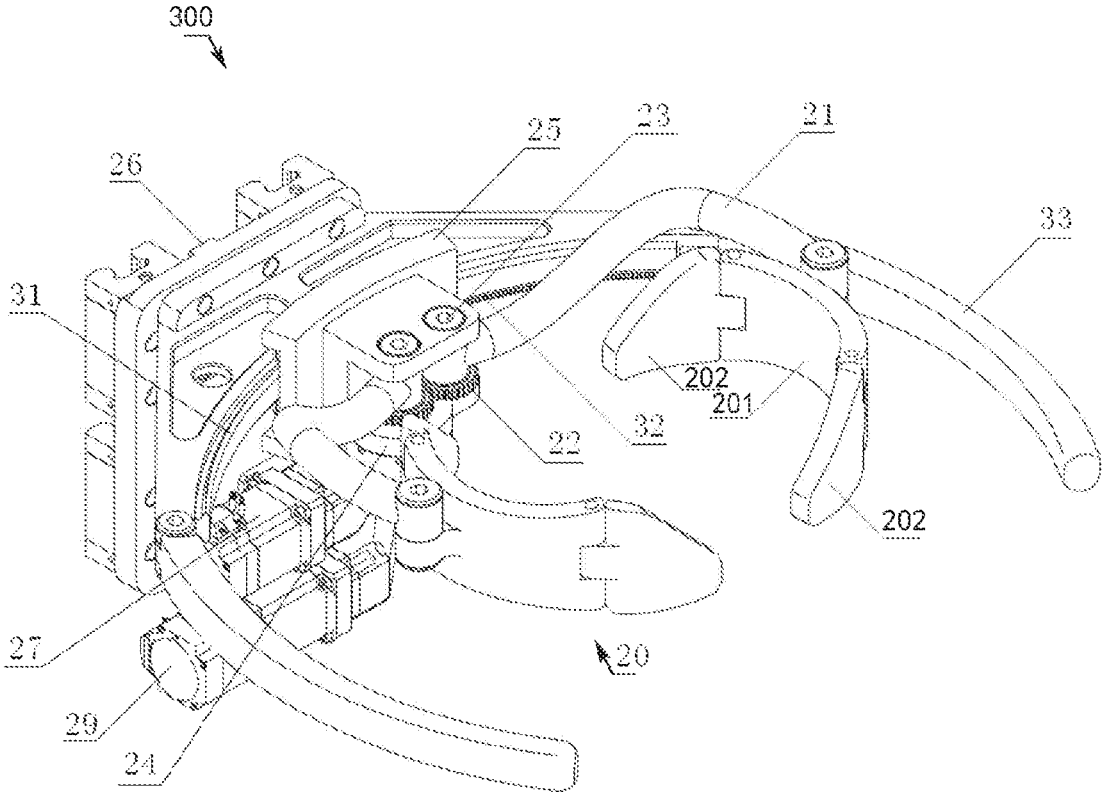
FIG. 7 is a schematic structural view of a lumbar traction and torsion device in the lumbar herniated disc treatment device of the present disclosure.

Exemplary embodiments will now be described more fully with reference to the accompanying drawings. However, the exemplary embodiments can be implemented in various forms and should not be construed as limiting the embodiments as set forth herein. Instead, these exemplary implementations are provided such that the present disclosure will be described more fully and completely, and concept of the exemplary implementations will completely conveyed to those skilled in the art. The same or similar parts in the drawings are shown in the same reference member, and accordingly the repeated description thereof will be omitted.

The relative words, such as "upper" or "lower", as used herein, are directed to describe a relative relationship between one component and the other component of an icon. These words are used herein for convenience only, for example, according to the direction of the illustrative examples as shown in the figures. It should be appreciated that if the referenced device is inversed upside down, the component indicated as being the "upper" side would become the component on the "lower" side. When one structure is "on" another structure, it is possible to indicate that the one structure is integrally formed on the other structure, or the one structure is "directly" arranged on the other structure, or one structure is "indirectly" formed on the other structure by means of a further structure.

The terms "a", "an", "the", "said" and "at least one", when describing element/constituent/or the like as described and/or shown herein, are used to express the presence of one or more the element/constitute/or the like. The terms "include", "comprise" and "have", as used herein, are intended to be inclusive, and mean there may be additional elements/constituents/or the like other than the listed elements/constituents/or the like.

Lumbar herniated disc is one of the most common diseases in orthopedics, which seriously affects life quality of patients. Clinical experience shows that the combined therapy of traction, torsion and massage can achieve better treatment effects. However, the existing lumbar herniated disc medical device has a single function and can only provide traction or massage therapy. To implement the combined therapy, a traction bed and a massage bed can be used alternately only, this not only prolongs the treatment time, reduces the treatment efficiency, and also greatly reduces the treatment effect. Accordingly, it is necessary to design a lumbar herniated disc medical device capable of simultaneously implementing three physical therapies.

An object of the present disclosure is to provide a lumbar herniated disc treatment device capable of simultaneously implementing traction, torsion and massage therapies, aiming at disadvantages in the prior art, so as to improve the treatment efficiency and treatment effect of lumbar herniated disc diseases and reduce the treatment costs.

The lumbar herniated disc treatment device acts on the lumbar spine by using a pulling force and a reverse pulling force. The Treatment of lumbar herniated disc can be achieved by pulling and twisting in opposite directions. Lumbar traction can increase a lumbar intervertebral space, mainly the space of the spines 3, 4, 5 and sacrum 1. It shows through study that the lumbar intervertebral space after traction is widened by 1.5-2.5 mm. Widening the lumbar intervertebral space to form an internal negative pressure, and tensioning the longitudinal ligament after the traction can facilitate for returning a protruded nucleus pulposus or changing its relationship with a nerve root. As the increasing of the lumbar intervertebral space and extension of articular joint, an intervertebral foramen can return to its normal shape, and thus relieving the compression of the nerve root. Traction can also make lumbar get sufficient rest, reduce stimulation of exercise, can facilitate absorption and regression of tissue congestion and edema, and also can relieve muscle spasm and intervertebral pressure.

Referring to FIG. 1, the lumbar herniated disc treatment device of the present disclosure includes: an upright post 1, a rack 2 parallel to a rail 3 and mounted on the upright post 1, a rail 3 vertically mounted on the upright post 1, and a chest fixing device 100 up-and-down slidably mounted on the rail 3, a lumbar traction and torsion device 300 up-and-down slidably mounted on the rail 3 and positioned below the chest fixing device 100, a waist massage device 200 up-and-down slidably mounted on the rail 3 and located between the chest fixing device 100 and the lumbar traction and torsion device 300.

In the present disclosure, a vertical traction frame is adopted, which is different from the conventional horizontal traction frame, in which the patient is pulled in a standing position, being more in line with biomechanics and ergonomics. In addition, the treatment device can accelerate bone reduction and improve treatment effect by twisting the lumbar.

Referring to FIGS. 2 to 4 and FIG. 7, the lumbar traction and torsion device 300 includes a lower sliding seat 26 up-and-down slidably mounted on the rail 3, a gear meshed with the rack 2 on a back surface of the lower sliding seat 26, an arc-shaped guide rail 31 mounted on a front surface of the lower sliding seat 26, an arc-shaped rack 32 arranged on the arc-shaped guide rail 31, a pulling motor 29 mounted on the lower sliding seat 26 for driving rotation of the lower synchronous gear a torsion seat 25 slidably mounted on the arc-shaped guide rail 31, the torsion seat 25 being provided with a gear meshed with the arc-shaped rack 32, a torsion motor 27 mounted on the torsion seat 25 for driving rotation of the gear on the torsion seat 25, a lower synchronous opening and closing mechanism mounted on the torsion seat 25, and a pair of ilium pressing plates 20 mounted on the lower synchronous opening and closing mechanism and arranged opposite to each other.

In one embodiment, the lower synchronous opening and closing mechanism includes a pair of lower rotating shafts 23 vertically mounted on the torsion seat 25, a pair of lower synchronizing gears 22 respectively mounted on the pair of lower rotating shafts 23 and meshed with each other, and a pair of lower clamping arms 21 respectively mounted on the pair of lower rotating shafts 23. In one embodiment, the pair of ilium pressing plates 20 are respectively mounted at the ends of one pair of the lower clamping arms 21.

In another embodiment, the lower synchronous opening and closing mechanism further includes a lower shaft brake 24 mounted on the torsion seat 25 and connected to one of the pair of the lower rotating shafts 23 in one embodiment.

In one embodiment, the lower clamping arm 21 is presented in a L shape.

In one embodiment, the pair of ilium pressing plates 20 are rotatably mounted on the pair of lower clamping arms 21, respectively.

In one embodiment, each of the ilium pressing plates 20 includes an arc-shaped lower intermediate plate 201 pivoted to the lower clamping arm 21, and two lower side plates 202 respectively pivoted to both sides of the lower intermediate plate 201.

In another embodiment, the lumbar traction and torsion device 300 further includes two arc-shaped handrails pivoted to both ends of the arc-shaped guide rail 31. In one embodiment, the handrails and the arc-shaped guide rail 31 have the same radian.

Referring to FIGS. 2 to 5, in one embodiment, the chest fixing device 100 includes: an upper sliding seat 4 up-and-down slidably mounted on the rail 3 and positioned above the lower slide 26, and the back surface of the upper sliding seat 4 being provided with a gear meshed with the rack 2; a lifting motor 5 mounted on the upper sliding seat 4 for driving rotation of the gear on the upper sliding seat 4; an upper synchronous opening and closing mechanism mounted on the front surface of the upper sliding seat 4; and a pair of armpit supporting plates 11 respectively mounted on the upper synchronous opening and closing mechanism and arranged opposite to each other.

In one embodiment, the upper synchronous opening and closing mechanism of the chest fixing device 100 includes a pair of upper rotating shafts 9 vertically mounted on the upper sliding seat 4, a pair of upper synchronous gears 8 respectively mounted on the pair of upper rotating shafts 9 and meshed with each other, and a pair of upper clamping arms 10 respectively mounted on the pair of upper rotating shafts 9. In one embodiment, the pair of armpit supporting plates 11 are rotatably mounted at the ends of the pair of upper clamping arms 10, respectively.

In another embodiment, the upper synchronous opening and closing mechanism further includes an upper shaft brake 7 mounted on the upper sliding seat 4 and connected to one of the pair of the upper rotating shafts 9 in one embodiment.

In one embodiment, each of the armpit supporting plates 11 includes an arc-shaped upper intermediate plate 110 pivoted to the upper clamping arm 10, and two upper side plates 111 pivoted to both sides of the upper intermediate plate 110.

Referring to FIGS. 2 to 4 and FIG. 6, in one embodiment, the waist massage device 200 includes: an intermediate sliding seat 13 up-and-down slidably mounted on the rail 3, and the back surface of the intermediate sliding seat 13 being provided with a gear meshed with the rack 2; a height adjusting motor 14 mounted on the intermediate sliding seat 13 for driving rotation of the gear on the intermediate sliding seat 13; a pair of intermediate rotating shafts vertically mounted on the intermediate sliding seat 13, the pair of intermediate rotating shafts being located at both sides of the front surface of the intermediate sliding seat 13; a pair of intermediate clamping arms 18 having one end respectively connected to the pair of intermediate rotating shafts; an abdominal baffle 19 having two ends respectively connected to the other end of the pair of intermediate clamping arms 18; a limiting frame 12 movably connected to the pair of intermediate clamping arms 18 and arranged opposite to the abdominal baffle 19; a horizontal pushing rod 16 having one end fixed to the intermediate sliding seat 13 and the other end extending towards the limiting frame 12; and one or more massagers 17 mounted at the end of the horizontal pushing rod 16.

In one embodiment, the horizontal pushing rod 16 is a telescopic rod.

In one embodiment, the waist massage device 200 includes two electromagnetic massagers 17.

Referring to FIGS. 2 to 7, the two ilium supporting plates 11 are used to carry the patient's body and provide upward pulling force to the lumbar spine. The ilium supporting plates 11 are connected to the upper sliding seat 4 through the upper clamping arm 10. In order to adapt to patients with different body types, a gap between the two ilium supporting plates 11 can be adjusted by a synchronous opening and closing mechanism consisting of an upper shaft brake 7, an upper rotating shaft 9 and an upper synchronous gear 8, and then can be locked by an upper shaft brake 7 after adjustment. In order to adapt to patients in different heights, the height of the upper sliding seat 4 is adjusted by a lifting motor 5, and a gear meshed with the vertical rack 2 is driven to rotate through a lifting reducer 6 when the lifting motor 5 is rotated, so that the upper sliding seat 4 and an ilium supporting plate 11 connected with the upper sliding seat 4 are driven to rise or fall.

The two ilium pressing plates 20 are pressed against the patient's ilium for exerting downward pulling force on the lumbar. The pulling motor 29 is provided with a pulling transmission 30. The gear meshed with the vertical rack 2 is driven to rotate through the pulling transmission 30 when the pulling motor 29 rotates, so that the lower sliding seat 26, the torsion seat 25 connected with the lower sliding seat 26, the lower clamping arm 21 and the ilium pressing plate 20 are driven to rise or fall. The torsion seat 25, the torsion motor 27, the torsion transmission 28, the arc-shaped guide rail 31 and the arc-shaped rack 32 are used for exerting the torsion force on the ilium. The arc-shaped guide rail 31 and the arc-shaped rack 32 are fixed on the lower sliding seat 26 and have the same shape. The torsion seat 25 is slidingly connected with the arc-shaped guide rail 31 through rollers. The torsion motor 27 and the torsion transmission 28 are fixed on the torsion seat 25. The gear meshed with the arc-shaped rack 32 is driven to rotate through the torsion transmission 28 when the torsion motor 27 rotates, so that the torsion seat 25, the lower clamping arm 21 connected with the torsion seat 25 and the ilium pressing plate 20 are driven to rotate within a certain range, and further realizing the torsion of the ilium. In order to adapt to patients with different body types, the gap between the two ilium pressing plates 20 can be adjusted and locked by a lower synchronous opening and closing mechanism consisting of a lower synchronous gear 22, a lower shaft brake 24 and a lower rotating shaft 23 (having the same adjustment principle as that of the ilium supporting plate 11).

The waist massage device is used for correcting and massaging the lumbar spine of the patient. The height adjusting motor 14 is provided with a height adjusting reducer 15. The height adjusting motor 14 is used for adjusting the height of the whole waist massage device to adapt to patients with different body types. The horizontal pushing rod 16 and the electromagnetic massager 17 are used for massaging the lumbar spine of the patient. The two electromagnetic massagers 17 are configured and arranged at the ends of the horizontal pushing rod 16 and are respectively positioned at two sides of the lumbar spine of the patient. The horizontal pushing rod 16 and the two intermediate clamping arms 18 are hinged with the intermediate sliding seat 13 through vertical hinge shafts, and can rotate along with the waist when the patient's waist of the patient twists. The function of the limiting frame 12 is to limit the electromagnetic massager 17 to prevent the electromagnetic massager 17 from deviating from the lumbar spine of the patient. The abdomen baffle 19 is used for limiting the waist and abdomen of the patient to prevent a larger displacement due to the push of the electromagnetic massager 17.

The electromagnetic massager 17 is a physiotherapy instrument for patients to perform treatment and health care by themselves. The physiotherapy instrument is made from a motor with a permanent magnet added with eccentric weights, and changing rotating speed of the motor is changing the massage frequency, whereby it can have a mechanical massage function and also a pulsating magnetic function. The instrument is simple in structure, easy to adjust, convenient to use, safe and reliable.

The operation steps of the present disclosure are as follows:

step 1. adjusting the heights of the ilium pressing plates 20, the electromagnetic massagers 17 and the ilium supporting plates 11 according to specific body types of the patients, opening the abdominal baffle 19 and adjusting a distance between the two ilium pressing plates 20 and a distance between the two ilium supporting plates 11 to the maximum;

step 2. connecting the two ends of the abdominal baffle 19 with the intermediate clamping arm 18 when the patient stands between the two ilium pressing plates 20 and the two armpit supporting plates 11;

step 3. moving the two armpit supporting plates 11 into the two armpits of the patient while adjusting the height and distance of the two ilium pressing plates 20, to make them higher than the patient's ilium and tightly attach to both sides of the patient respectively, and then locking the upper rotating shaft 9 and the lower rotating shaft 23 by using the upper shaft brake 7 and the lower shaft brake 24, such that the distance between the two ilium pressing plates 20 and the distance between the two armpit supporting plates 11 cannot be changed any more;

step 4. starting the lifting motor 5 or the pulling motor 29 to move the upper sliding seat 4 upward or move the lower slide 26 downward, so that the lumbar vertebra can bear appropriate pulling force;

step 5. starting the torsion motor 27 to rotate the two ilium pressing plates 20 so as to apply the torsion force to the lumbar spine of the patient;

step 6. starting the electromagnetic massager 17 to perform massage treatment on the both sides of the patient's lumbar spine;

step 7. when reaching a predetermined treatment time, closing the electromagnetic massager 17, unlocking the upper shaft brake 7 and the lower shaft brake 24, opening the abdominal baffle 19, and then allowing the patient to leave from the treatment device, in this round, the treatment s completed.

The lumbar herniated disc treatment device of the present disclosure can be controlled by medical personnel, and also can be controlled by the patient through an operation panel or a remote controller.

According to the lumbar herniated disc treatment device of the present disclosure, the treatment devices with various physical therapies are mounted on the same upright post, which can effectively improve the treatment efficiency and treatment effect of the lumbar herniated disc diseases, reduce the treatment costs, and permit small occupation, and thus being suitable for families and medical institutions.

Other embodiments of this application will be apparent to those skilled in the art for consideration of the specification and practice of the disclosure herein. This application is intended to cover any variations, uses, or adaptations of the invention following the general principles thereof and including such departures from the present disclosure as come within known or customary practice in the art. It is intended that the specification and examples can be considered as illustrative only, with a real scope and spirit of the invention being indicated by the following appended claims.

What is claimed is:

1. A lumbar herniated disc treatment device, comprising:

an upright post;

a rail vertically mounted on the upright post;

a chest fixing device up-and-down slidably mounted on the rail;

a lumbar traction and torsion device up-and-down slidably mounted on the rail and positioned below the chest fixing device; and a waist massage device up-and-down slidably mounted on the rail and positioned between the chest fixing device and the lumbar traction and torsion device, wherein a rack parallel to the rail is mounted on the upright post, and the lumbar traction and torsion device comprises:

a lower sliding seat up-and-down slidably mounted on the rail, and a back surface of the lower sliding seat being provided with a gear meshed with the rack;

an arc-shaped guide rail mounted on a front of the lower sliding seat;

an arc rack arranged on the arc guide rail;

a pulling motor mounted on the lower sliding seat for driving rotation of a lower synchronous gear;

a torsion seat slidably mounted on the arc-shaped guide rail, the torsion seat being provided with a gear meshed with the arc-shaped rack;

a torsion motor mounted on the torsion seat for driving rotation of the gear on the torsion seat;

a lower synchronous opening and closing mechanism comprising a pair of lower rotating shafts, the lower rotating shafts vertically mounted on the torsion seat; and a pair of ilium pressing plates mounted on the lower synchronous opening and closing mechanism and arranged opposite to each other.

2. The lumbar herniated disc treatment device according to claim 1, wherein the lower synchronous opening and closing mechanism further comprises:

a pair of lower synchronous gears respectively mounted on the pair of lower rotating shafts and meshed with each other; and a pair of lower clamping arms respectively mounted on the pair of lower rotating shafts;

wherein the pair of ilium pressing plates are respectively mounted at ends of the pair of the lower clamping arms.

3. The lumbar herniated disc treatment device according to claim 2, wherein the lower synchronous opening and closing mechanism further comprises:

a lower shaft brake mounted on the torsion seat and connected to one of the lower rotating shafts.

4. The lumbar herniated disc treatment device according to claim 2, wherein the lower clamping arm is L-shaped.

5. The lumbar herniated disc treatment device according to claim 2, wherein the pair of ilium pressing plates are rotatably mounted on the pair of lower clamping arms, respectively.

6. The lumbar herniated disc treatment device according to claim 2, wherein each of the ilium pressing plates comprises:

an arc-shaped lower intermediate plate pivoted to the lower clamping arm, and two lower side plates respectively pivoted to both sides of the lower intermediate plate.

7. The lumbar herniated disc treatment device according to claim 1, wherein the lumbar traction and torsion device further comprises:

two arc-shaped handrails respectively pivoted to both ends of the arc-shaped guide rail, wherein the handrails and the arc-shaped guide rail have same radian.

8. The lumbar herniated disc treatment device according to claim 1, wherein the chest fixing device comprises:

an upper sliding seat up-and-down slidably mounted on the rail and positioned above the lower sliding seat, and the back surface of the upper sliding seat being provided with a gear meshed with the rack;

a lifting motor mounted on the upper sliding seat for driving rotation of the gear on the upper sliding seat;

an upper synchronous opening and closing mechanism mounted on the front of the upper sliding seat; and a pair of armpit supporting plates mounted on the upper synchronous opening and closing mechanism and arranged opposite to each other.

9. The lumbar herniated disc treatment device according to claim 8, wherein the upper synchronous opening and closing mechanism comprises:

a pair of upper rotating shafts vertically mounted on the upper sliding seat;

a pair of upper synchronous gears respectively mounted on the pair of upper rotating shafts and meshed with each other; and a pair of upper clamping arms respectively mounted on the pair of upper rotating shafts;

wherein the pair of armpit supporting plates are rotatably mounted at the ends of the pair of upper clamping arms, respectively.

10. The lumbar herniated disc treatment device according to claim 9, wherein the upper synchronous opening and closing mechanism further comprises:

an upper shaft brake mounted on the upper sliding seat and connected with one of the pair of upper rotating shafts.

11. The lumbar herniated disc treatment device according to claim 9, wherein each of the armpit supporting plates comprises:

an arc-shaped upper middle plate pivoted to the upper clamping arm, and two side plates respectively pivoted to both sides of the upper intermediate plate.

12. The lumbar herniated disc treatment device according to claim wherein the waist massage device comprises:

an intermediate sliding seat up-and-down slidably mounted on the rail, and the back surface of the intermediate sliding seat being provided with a gear meshed with the rack;

a height adjusting motor mounted on the intermediate sliding seat for driving rotation of the gear on the intermediate sliding seat;

a pair of intermediate rotating shafts vertically mounted on the intermediate sliding seat, the pair of intermediate rotating shafts being positioned at both sides of a front of the intermediate sliding seat;

a pair of intermediate clamping arms having one end respectively connected with the pair of intermediate rotating shafts;

an abdomen baffle having two ends respectively connected with the other end of the pair of intermediate clamping arms;

a limiting frame movably connected to the pair of intermediate clamping arms and arranged opposite to the abdominal baffle;

a horizontal pushing rod having one end fixed on the intermediate sliding seat and the other end extending towards the limiting frame; and one or more massagers mounted at the end of the horizontal pushing rod.

13. The lumbar herniated disc treatment device according to claim 12, wherein the horizontal pushing rod is a telescopic rod.

14. The lumbar herniated disc treatment device according to claim 12, wherein the waist massage device comprises two electromagnetic massagers.

* * * * *